United States Patent [19]

Paseman

[11] Patent Number: 4,605,028

[45] Date of Patent: Aug. 12, 1986

[54] TUBE CLEANING APPARATUS

[76] Inventor: Richard R. Paseman, 5517 Newport, Houston, Tex. 77023

[21] Appl. No.: 642,262

[22] Filed: Aug. 20, 1984

[51] Int. Cl.[4] ..... B08B 3/02

[52] U.S. Cl. ..... 134/167 C; 15/104.1 R; 239/240; 239/DIG. 13

[58] Field of Search ..... 134/166 R, 166 C, 167 R, 134/167 C, 172; 15/104.1 R, 104.16, 104.20; 239/DIG. 13, 240, 242, 237, 381; 92/81, 157, 158, 160

[56] References Cited

U.S. PATENT DOCUMENTS

| | | | |
|---|---|---|---|
| 620,224 | 2/1899 | Bubser . | |
| 2,494,380 | 1/1950 | Ellig . | |
| 2,543,340 | 2/1951 | Slasor et al. | 92/81 |
| 2,803,842 | 8/1957 | Fuller | 15/104.1 R |
| 3,060,900 | 10/1962 | Pelouch | 92/81 X |
| 3,246,660 | 4/1966 | Hammelmann . | |
| 3,246,847 | 4/1966 | Hammelmann . | |
| 3,269,659 | 8/1966 | Shelton et al. . | |
| 3,377,026 | 4/1968 | DeMart et al. . | |
| 3,477,343 | 11/1969 | Dayson | 92/81 X |
| 3,589,388 | 6/1971 | Haneline, Jr. . | |
| 3,736,909 | 6/1973 | Marangoni et al. . | |
| 3,791,583 | 2/1974 | Nunlist et al. . | |
| 3,794,051 | 2/1974 | Lee, Jr. et al. . | |
| 3,817,262 | 6/1974 | Caradeur et al. . | |
| 3,901,252 | 8/1975 | Riebe . | |
| 3,903,912 | 9/1975 | Ice, Jr. et al. . | |
| 3,938,535 | 2/1976 | Cradeur et al. . | |
| 3,987,963 | 10/1976 | Pacht . | |
| 4,137,928 | 2/1979 | Sentell . | |
| 4,143,821 | 3/1979 | Aghnides | 239/381 |
| 4,344,570 | 8/1982 | Paseman . | |

FOREIGN PATENT DOCUMENTS

| | | | |
|---|---|---|---|
| 260805 | 10/1970 | U.S.S.R. | 92/158 |

*Primary Examiner*—Robert W. Jenkins
*Assistant Examiner*—Frankie L. Stinson
*Attorney, Agent, or Firm*—Pravel, Gambrell, Hewitt & Kimball

[57] ABSTRACT

An apparatus for cleaning tubular elements with pressurized fluid including an improved fluid driver, reciprocating lance means having interchangeable piston portions and nozzles to enable the speed of the lance to be controlled is provided.

8 Claims, 4 Drawing Figures

TUBE CLEANING APPARATUS

BACKGROUND OF THE INVENTION

1. Field of the Invention

This invention relates to apparatus for cleaning the interior of tubular elements such as are used in tube bundle heat exchanger assemblies and the like. More specifically, this invention relates to cleaning such tubular elements using a reciprocating, fluid-driven cleaning lance.

2. Description of the Prior Art

Tubing and tube bundles, particularly those in heat exchangers, generally require periodic cleaning. Fluid pressure tube cleaning apparatus in general were disclosed in U.S. Pat. Nos. 620,224; 2,494,380; 3,246,660; 3,269,659; 3,377,026; 3,589,388; 3,736,909; 3,794,051; 3,817,262; 3,901,252; 3,903,912; 3,938,535 and 3,987,963. It is also known to use a reciprocating fluid driven lance having one or more nozzles for directing cleaning fluid under pressure at the interior passageway of the tubing to dislodge foreign substances and clean the tubing. Such fluid pressure tube cleaning systems were disclosed in U.S. Pat. Nos. 3,246,847; 3,791,583; and 4,137,928 (which is owned by applicant). An improved reciprocating lance apparatus having a novel means for dampening the reciprocating motion of the lance was disclosed in U.S. Pat. No. 4,344,570 of which applicant is the inventor.

Reciprocating lance cleaning apparatus generally included a hollow lance portion and a piston portion. The lance portion typically had a spray nozzle at one end for directing the cleaning fluid to the interior of the tubes, and the piston portion was adapted for reciprocating motion in a tubular housing in response to fluid pressure differentials acting in alternating fashion upon one or more piston surfaces. Such systems were disclosed for example in U.S. Pat. Nos. 4,137,928 and 4,344,570. In these systems, the lance housing included a controllable pressurized fluid inlet at the forward end of the housing and a controllable fluid outlet near the rear of the housing. The lance was driven back and forth in the housing by controlling the inlet and outlet valves to alternately create a pressure differential in front and behind the piston portion of the lance. One problem which developed in the operation of these prior systems was that if the system was stopped when the lance was in the rear most portion of the housing, it was difficult if not impossible for the driving fluid to reach and act upon the rear face of the piston or enter the interior of the lance so that normal reciprocal operations could resume.

Other lance cleaning systems included threaded surfaces upon the lance body or the piston portion to cause the lance to rotate about its longitudinal axis in response to fluid dynamics acting upon the threaded surfaces. Such systems were disclosed in U.S. Pat. Nos. 4,137,928 and 4,344,570. In these systems, a single lead raised, threaded portion of the lance body or piston was fitted relatively snugly within the tubular lance housing. Consequently, substantially all of the fluid traversing the exterior of the lance body was forced to flow in the grooved path created between the threaded portion of the piston and the interior of the tubular housing. These systems suffered problems in delivering adequate rotational and translational movement of the lance. Further, no provision was made to vary or control the rotational or transverse speed of the lance.

SUMMARY OF THE INVENTION

The present invention includes a fluid driven reciprocating lance having interchangeable piston portions and nozzles so that the transverse and rotational speed of the lance can be controlled. Since the lance speed is prescribed by the difference in fluid pressure experienced at the opposite ends of the lance body, in the present invention the speed of reciprocation of the lance is controlled by the selection of one of several interchangeable lance pistons having different outside diameters and by the selection of one of several interchangeable lance nozzles having different diameters or numbers of nozzle holes. The rotational speed of the lance is prescribed by the angular momentum imparted to the lance piston by the driving fluid as it flows forward around the piston within the lance housing. The rotational speed of the lance is also controlled by selecting one of the interchangeable lance pistons having different outside diameters, thereby enlarging or restricting the fluid passage way formed between the lance piston and the interior of the lance housing.

With the present invention, the fluid driven lance is easily started in the forward direction even when operation is stopped with the lance at the rear end of the lance housing. The cylindrical piston portion of the lance according to present invention is formed having a plurality of grooves extending from the perimeter of the rear face of the piston to the central bore which extends longitudinally through the lance body thereby permitting fluid pressure to reach the rear surface of the piston irrespective of its proximity to the rear end cap of the lance housing.

DESCRIPTION OF THE PREFERRED EMBODIMENT

Figure 1:
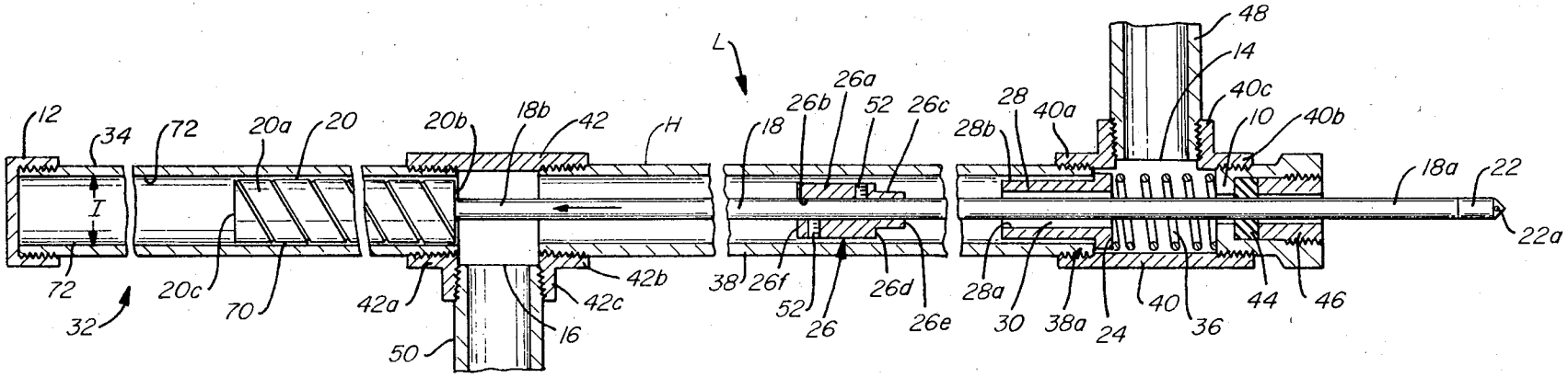
FIG. 1 is a cross-sectional view of an apparatus according to the present invention showing the lance near the end of its rearward motion.

Referring now to the drawings, FIG. 1 shows a fluid power lance assembly L according to the present invention. A hollow cleaning lance 18 is mounted in a housing H for reciprocal sliding motion in response to fluid pressure in the housing H acting on a piston 20 mounted adjacent to a rear lance end 18*b*. Lance 18 is supported within housing H at a forward end 18*a* by lance guide 10 and at the rearward end 18*b* by piston 20 in association with pressurized fluid contained within the bore of housing H. A cleaning nozzle 22 is mounted on lance forward end 18*a* which extends outside of housing H.

Lance L may also include a forward motion arresting means 24 mounted within housing H. Arresting means 24 includes plug member 26, mounted with lance 18, and a body member 28. Body member 28 includes a fluid passage 30 formed between member 28 and lance 18 which communicates with a fluid inlet 14. Arresting means 24 is constructed and operates in accordance with a similar structure described in U.S. Pat. No. 4,344,570 of which applicant is the inventor, the contents of which are incorporated by reference herein as if fully set forth. In a similar manner to this patent, lance assembly L may include a resilient absorbing means 36, such a spring or the like, mounted between body member 28 and the lance guide member 10 to further absorb the forward motion of the lance 18. Rearward motion arresting means 32 includes a reservoir portion 34, between a fluid outlet 16 and a housing end cap 12, which receives fluid to dampen the rearward motion of the lance 18 and piston 20.

The generally cylindrical housing H is of the type shown in U.S. Pat. Nos. 4,344,570 of which applicant is inventor, and 4,137,928, of which applicant is owner, and includes an end cap 12 which is securely, threadedly engaged to the cylindrical reservoir portion 34. Reservoir portion 34 is threadedly engaged to an outlet T-connection 42 by a fitting 42*a*. An outlet T-connection fitting portion 42*b* is, in turn, threadedly engaged to one end of a cylindrical main housing portion 38. Main housing portion 38 is threadedly engaged, at its other end, to an inlet T-connection 40 at fitting 40*a*. An inlet T-connection fitting 40*b* is securely engaged to front lance guide 10 by a stuffing 44 which in turn is held in place by retainer fitting 46. Retainer fitting 46 also acts as a supporting guide for lance 18. Pressurized fluid to drive the lance 18 is supplied to the housing H by a pressure hose 48 which is threadedly connected at fitting 40*c* to the inlet 14 adjacent the forward end 10. Pressure hose 48 is connected to a source of pressurized fluid (not shown). A hose 50 is connected to the outlet 16 at a fitting 42*c* and leads to a drain. Flow through hose 50 is controlled by a valve (not shown) in the manner of U.S. Pat. No. 4,137,928 previously referred to, the contents of which are incorporated herein as if fully set forth.

Lance 18 is a hollow steel tube of strength and dimensions sufficient to contain the volume of fluid under pressure necessary to clean blocked tubing. Lance 18 may, for example, be formed of stainless steel or other suitable corrosion resistant and sufficiently strong material. Nozzle 22 is mounted on the forward end 18*a* of lance 18 and is formed having a plurality of spray holes 22*a* whereby pressurized fluid from the interior of lance 18 is directed against the portion of the tube to be cleaned.

According to the present invention, a plurality of interchangeable nozzles 22 are provided, each having a different number of fluid holes 22*a*, or having holes 22*a* of different diameter to provide a means for prescribing the volume and velocity of fluid exiting lance 18. The different nozzle areas thus provided affect the pressure differential experienced at the rear of piston 20 and lance 18 and enable the speed of reciprocation of the lance 18 within housing H to be controlled. For example, where lance 18 comprises ⅜" or 7/16" stainless steel tubing, a nozzle 22 having twelve 0.021" nozzle holes 22*a* has been found to be suitable to provide a relatively fast lance speed, and a nozzle 22 having sixteen to nineteen 0.021" nozzle holes 22*a* has been found to be suitable in applications requiring relatively slow lance speed. Generally speaking, a slow lance speed is desirable where extremely difficult cleaning operations are encountered, and a fast lance travel is desirable in relatively easy cleaning operations so as to both reduce the labor time involved in cleaning large bundles of tubing and also to knock out any plugged or heavily fouled sections in the tubing.

Figure 4:
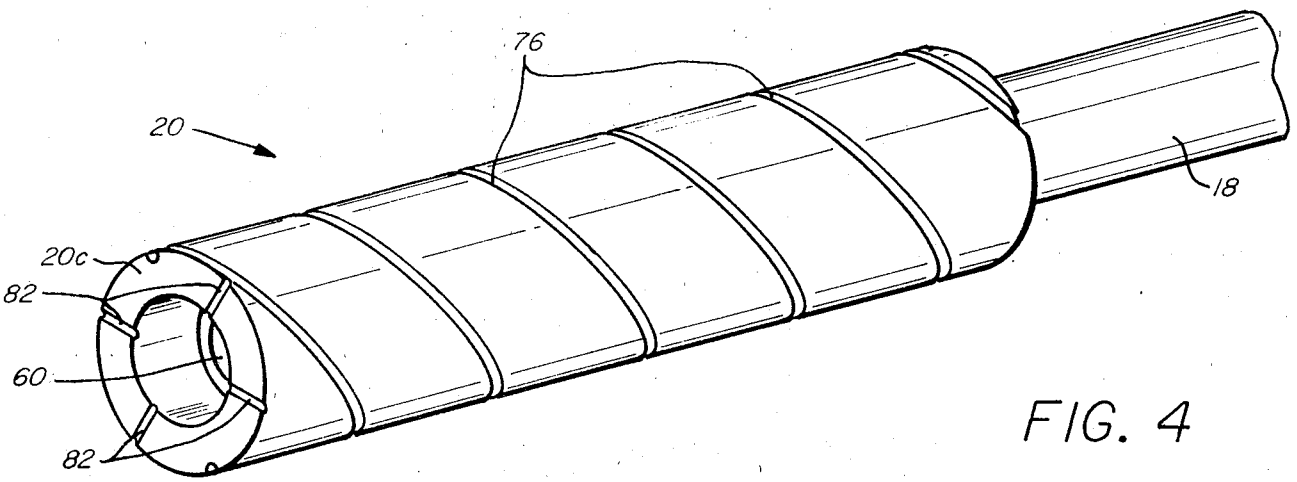
FIG. 4 is an isometric view of the piston portion of the lance according to the present invention

Piston 20 (FIGS. 2, 3 and 4) is a generally cylindrical body formed of cold finish, hardened steel or similar material having an outside diameter slightly less than the inside tubular diameter of lance housing H. Piston 20 is also formed having an interior bore 60 of diameter equal to the interior diameter of lance 18, and enlarged end bores 62 and 64 formed at opposite ends of piston 20 and adapted to receive the outer dimension of lance 18. Lance 18 may then be received snugly within bore 64 and secured by any suitable means such as threaded surface 66 in piston 20 receiving rearward threaded end 68 of lance 18. The screw 66 extends when mounted no further outwardly than the outer surface of piston 20.

Piston 20 is formed having an outside diameter slightly less than the inner dimension of the tubular lance housing H so as to permit lance 18 and piston 20 to freely reciprocate and to rotate within housing H in response to fluid pressure in a manner to be described. Since the speed of the lance is dependent upon the fluid pressure differential experienced between rear surface 20*c* and front surface 20*b* of piston 20, the speed of the lance can be prescribed by varying the dimension or radius of annular gap 70 formed between piston 20 and inner surface 72 of housing H. For example where the inner diameter I of tubular housing sections 34 and 38 is 0.740 inches, the outer dimension of cylindrical piston 20 may be prescribed to one of several somewhat lesser dimensions, such as 0.721, 0.725 and 0.730 inches to control the fluid pressure differential acting upon rearward end 20*c* of piston 20 (FIG. 1 and consequently the transverse and rotational speed of lance 18.

Figure 2:
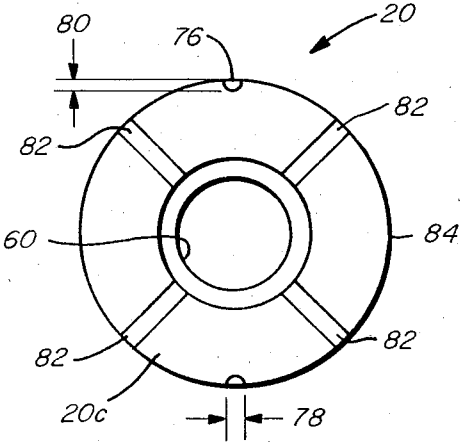
FIG. 2 is an end view of a piston portion of the apparatus according to the present invention illustrating the radial grooves formed therein.
Figure 3:
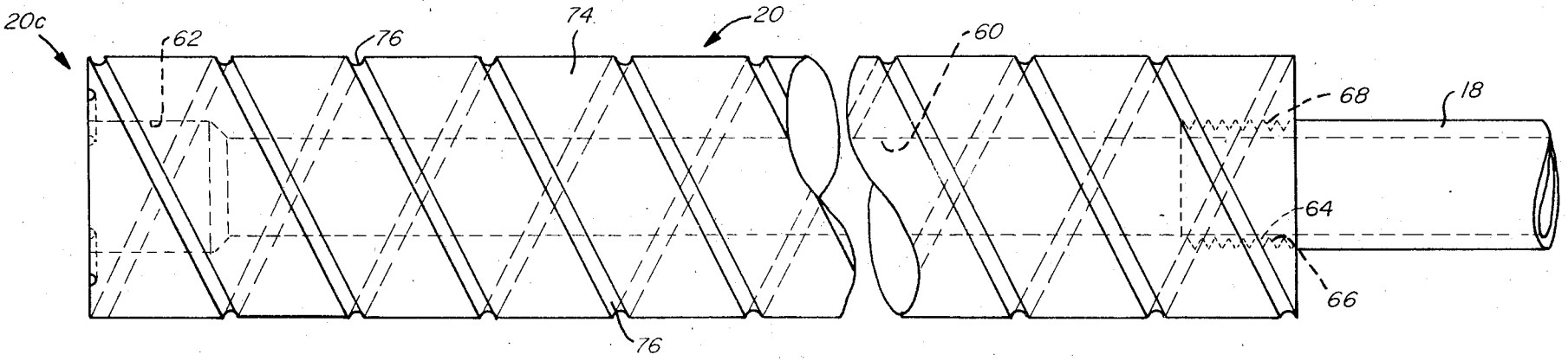
FIG. 3 is an elevation view of the piston portion of a lance in accordance with the present invention illustrating the double lead thread formed in the outer surface of the piston.

In order to impart effective rotation of lance 18, the outer surface 74 (FIG. 3) of piston 20 is provided with continuous, double lead threading 76 from rear end 20*c* to forward end 20*b*. Where piston 20 is approximately 9 to 10 inches in length, the optimal threading has been determined to be a double lead, one turn per inch thread having a 1/16" radius 78 and a 0.045" depth 80 (FIG. 2). Threading the piston 20 in this manner has been shown to provide an effective amount of angular momentum to lance 18 to cause lance 18 to rotate about its longitudinal axis as it reciprocates within housing H thereby providing a more effective cleaning action.

Referring now to FIG. 2, rear surface 20*c* of piston 20 is illustrated in detail. Surface 20*c* is formed having a plurality of grooves 82, preferably radial, although tangential or other forms might be used. The grooves 82 provide a fluid communication path from the perimeter 84 of piston 20 to interior bore 60 even when piston 20 is at the extreme rearward position in housing H so that surface 20*c* abuts end cap 12. Thus, when piston 20 is in its extreme rearward position, fluid is still able to pass through annular gap 70 (FIG. 1), grooves 82 and enter bore 60 thereafter passing forward in lance 18 to be discharged through nozzle 22. This provides a pressure differential acting upon rear surface 20*c* of piston 20 to start piston 20 moving forward. This feature avoids the problem found with prior systems where the lance would sometimes become lodged in its rearward extreme position and could not be dislodged in response to fluid pressure to resume normal reciprocating motion.

In operation of the power lance L, a valve attached to hose 50 (FIG. 1) is open so that fluid may flow under pressure entering housing H through hose 48 and inlet 14. The fluid flows through passage 30, past plug member 26 and, acting upon the piston forward surface 20*b*, forces piston 20 and lance 18 rearward toward the housing end cap 12. As piston 20 passes fluid outlet 16 and enters reservoir 34, the fluid in the reservoir portion 34 acts as a hydraulic stop to dampen the rearward motion of lance 18 and reduce the momentum of the piston 20 prior to its reaching end cap 12. To cause lance 18 to move forward, the valve in hose 50 is closed. Fluid pressure then acts on piston rearward surface 20*c* to forcibly drive the lance 18 forward and into the tube to be cleaned. Grooves 82 formed in surface 20*c* have been found to greatly enhance the operation of fluid upon rear surface 20*c* to begin this forward portion of lance reciprocation. As lance 18 reaches its forward position, plug member 26 approaches cylindrical body member 28, with radial reduced portion 26*c* entering fluid passage 30 and substantially preventing all fluid flow momentarily. At this point, there is considerably less pressure behind plug member 26 than in front of the body member 28. As plug member 26 engaged with body member 28 proceeds forward, the pressure differential acting upon surface 26*e* (FIG. 1) reduces the forward momentum of lance 18 and eventually forces plug member 26 to disengage from fluid passage 30, thereby limiting the forward motion of the lance 18. The resilient force absorbing means 26 shown as a coiled spring member provides additional dampening of the forward motion, reducing or substantially avoiding any possible destructive force upon lance guide 10.

The foregoing disclosure and description of the invention are illustrative and explanatory thereof, and various changes in the size, shape and materials, as well as in the details of the illustrated construction may be made without departing from the spirit of the invention.

I claim:

1. An apparatus for cleaning tubes, pipes or like elongate tubular objects with pressurized fluid from a controlled pressurized fluid reservoir, comprising:

(a) an essentially tubular lance housing having a front end and a rear end, said housing further comprising:

(1) a fluid inlet adjacent said front end;

(2) a fluid outlet adjacent said rear end;

(3) an essentially cylindrical central bore extending between said front end and said rear end;

(b) elongate lance means mounted for reciprocating motion within said central bore in said lance housing and adapted for dispensing pressurized cleaning fluid, said lance means comprising:

(1) an essentially tubular lance body having a first end, a second end, and a central longitudinal bore extending therebetween;

(2) nozzle means for controlling the volume and direction of fluid discharge from said lance means, said nozzle means being mounted adjacent said first end of said lance body in fluid communication with said lance bore;

(3) generally cylindrical piston means of outer dimension slightly less than the inner dimension of said housing bore, said piston means having a front surface, a rear surface, an essentially cylindrical outer surface and a central longitudinal bore extending the length thereof to enable fluid communication through said piston means to said lance bore, said piston means being mounted adjacent said second end of said lance body and adapted to cause reciprocating motion of said lance means in response to fluid pressure differentials acting alternatively upon said front surface and said rear surface; and (c) said rear surface of said piston means having a plurality of radial grooves formed thereon for providing fluid communication between said housing central bore and said rear surface of said piston.

2. The apparatus of claim 1, wherein said outer surface of said piston means has a double lead, spiral-threaded groove formed therein adapted to cause said piston means to rotate in response to fluid within the annulus formed between said piston means and an interior surface of said housing bore.

3. The apparatus of claim 2, wherein said piston means has an outer dimension of about 0.725 inches and said double lead threaded groove is a one revolution per inch double lead threaded groove.

4. The apparatus of claim 3 wherein said double lead groove is cut to be about 0.045 inches deep on a radius of 0.0625 inches.

5. The apparatus of claim 1, wherein said radial grooves in said rear surface are formed to have a maximum depth of from about 0.0125 inches to about 0.1875 inches.

6. The apparatus of claim 1, wherein said piston means comprises a plurality of interchangeable generally cylindrical piston members, each of said piston members having a different outer dimension, the selection of a particular piston member thereby providing a means for prescribing the speed of reciprocating movement of said lance means.

7. The apparatus of claim 6, wherein said lance housing bore has a diameter of about 0.740 inches and said interchangeable piston members have respective diameters of about 0.721 inches, 0.725 inches, and 0.730 inches.

8. The apparatus of claim 1, wherein said nozzle means comprises a plurality of interchangeable nozzle members having different nozzle dimensions to prescribe the volume and velocity of fluid discharged from said nozzle and thereby control the speed of reciprocating motion of said lance means.

* * * * *